United States Patent [19]

Tindall

[11] 3,985,301

[45] Oct. 12, 1976

[54] MULTI FLUID INJECTORS

[75] Inventor: David Tindall, Datchet, England

[73] Assignee: Spectus Oil Burner, Ltd., Ascot, England

[22] Filed: Jan. 13, 1975

[21] Appl. No.: 540,545

[30] Foreign Application Priority Data

Jan. 18, 1974 United Kingdom ..... 2589/74

[52] U.S. Cl. ..... 239/126; 239/464; 239/533

[51] Int. Cl.[2] ..... B05B 1/32; B05B 9/00

[58] Field of Search ..... 239/533, 584, 585, 88, 239/90, 91, 126, 124, 125, 464

[56] References Cited

UNITED STATES PATENTS 3,669,354 6/1972 Helyer ..... 239/126

FOREIGN PATENTS OR APPLICATIONS 291,497 5/1923 United Kingdom ..... 239/88

*Primary Examiner*—Robert S. Ward, Jr.

*Attorney, Agent, or Firm*—Lawrence E. Laubscher

[57] ABSTRACT

The invention comprehends a fluid injector comprising a liquid supply path to discharge passage means, a liquid return path for liquid supplied through the liquid supply path but not discharged through the discharge passage means, and a gaseous supply path to the discharge passage means and having a region in common with the liquid supply path, by which effecting a variation as between the liquid and gaseous pressures in said region will result in variation in the discharge of liquid from the fluid injector.

21 Claims, 15 Drawing Figures

MULTI FLUID INJECTORS

BACKGROUND AND SUMMARY OF THE INVENTION

This invention concerns improvements in or relating to fluid injectors.

According to the invention there is provided a fluid injector comprising a liquid supply path to discharge passage means, a liquid return path for liquid supplied through the liquid supply path but not discharged through the discharge passage means, and a gaseous supply path to the discharge passage means and having a region in common with the liquid supply path, by which effecting a variation as between the liquid and gaseous pressures in said region will result in variation in the discharge of liquid from the fluid injector.

BRIEF DESCRIPTION OF THE DRAWINGS

In order that the invention can be well understood there will now be described some embodiments thereof, given by way of example, reference being had to the accompanying drawings, in which.

DETAILED DESCRIPTION

Figure 1:
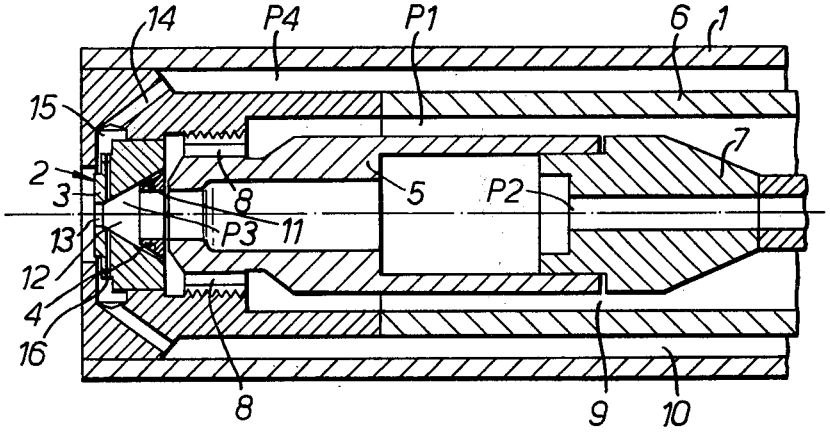
FIG. 1 is a sectional side elevation of a fluid injector when operative to deliver fluids through a fluid atomizer having a single discharge hole with provision to return fluid from the atomizer assembly.

Each of the fluid injectors to be described herein is primarily intended for incorporation in an oil burner suitable for use in an oil fired boiler, although the burner may have other process applications. A plurality of such burners would be arranged in the furnace walls of the boiler and may be used:

a. as burners that supply the total fuel requirements of the boiler;

b. as subsidiary burners that act as ignition devices for the main coal burners, when the primary fuel is coal; and c. as parts of burners with the dual capability of firing oil and gas as required.

The boiler would generate steam, and have land, marine and other industrial applications.

In the primary application of the fluid injector it discharges liquid fuel oil atomized to form a spray of droplets. Steam or gas (which could be compressed air) may be selectively mixed with the fuel oil before it is discharged to enhance its atomization under certain conditions of reduced fuel discharge, as will appear.

It is a particular requirement that oil burners (injectors) should be capable of reduced fluid discharge of 'Turndown'. The Turndown Ratio is usually defined as the ratio of the greatest fuel quantity combusted through a single burner to the smallest amount of fuel which can be combusted through that burner consistent with an acceptable standard of combustion.

In contemporary oil burners which employ fluid injectors, three principal mechanisms to achieve reduced fluid discharge have been proposed, as follows:

1. In one such mechanism, the fluid is atomized by forcing it at a high pressure (the supply pressure) through an orifice, and the rate of flow is varied by changing the supply pressure. The method is termed simply 'pressure jet atomization'.

It can be shown that the quantity of fluid discharged through the orifice is proportional to the square root of the supply pressure. This method has the disadvantage that wide variations of the supply pressure are necessary to achieve a significant variation of the quantity of fluid discharged. Because the quality of atomization of the fluid so discharged depends upon the conversation of the supply pressure energy to kinetic energy, extensive reduction of the supply pressure impairs the quality of atomization thus limiting the extent to which the fluid discharge can be turned down. In general, a Turndown Ratio of 1.5 to 1 is the greatest which can be achieved.

2. In the second mechanism a bleed-off is introduced behind the orifice plate. Fluid is supplied to the back of the discharge orifice where it may discharge through the orifice or be bled back to an alternative reservoir. This bleed arrangement is termed a 'spill return system'.

With this mechanism, the resistance in the bleed line (spill return pressure) is adjusted. Then, for a given supply pressure, as the spill return pressure is reduced more fluid is returned along the bleed line. This action reduces the quantity of fluid discharged through the atomizing orifice. Thus, the fluid discharged through the atomizing orifice may be reduced without a wide variation in the supply pressure and a consequent deterioration of the quality of fluid atomization. For practical purposes this mechanism can achieve a Turndown Ratio of 2 or even 3 to 1, i.e. as much as twice that achieved by the previously discussed simple pressure jet atomizing mechanism.

The spill return pressure arrangement requires an increase in the total fluid supplied to the back of the discharge orifice as the spill return flow increases, even though the discharged quantity of fluid reduces. The extra pumping capacity required for such a system tends to limit the maximum Turndown Ratio that can be regarded as practical to 2.5 to 1.

3. The third mechanism utilizes a second fluid, generally steam or air, with the simple pressure jet atomizing mechanism as described above, to regulate fluid discharge.

In such a mechanism, the second fluid is introduced behind the discharge orifice in parallel with the primary fluid. Because of the pressure gradient which exists across the fluid atomizing orifice then, where the second fluid is of a geseous nature, its rate of expansion is greater than that of the liquid primary fluid. For this reason, a small mass flow of a gas can displace a much greater mass flow of liquid and, therefore, a small variation in the second fluid throughput can cause a much wider variation in the primary fluid discharged through the atomizing orifice. With this mechanism, a Turndown Ratio in excess of 6 to 1 can be obtained, some even claiming 12 or 14 to 1. Such a Turndown Ratio is regarded as totally impractical for combustion purposes by well informed users.

We have now devised a fluid injector which combines the concept of "second fluid regulation" with 'spill return pressure regulation'.

A major obstacle to such a combination is the potential entrainment of the secondary gaseous fluid into the primary fluid return line. Each of the embodiments of the fluid injector herein is so constructed as to ensure that steam or gas supplied to the injector will not become entrained in the liquid fuel oil which may be returned at the same instance.

Contemporary systems proposed for combining second fluid regulation with the simple pressure jet atomising arrangement would use appreciable quantities of that second fluid in order to achieve a particular Turndown Ratio. This does have disadvantages. An excess of the second fluid impairs the atomization, and can also lead to economic disadvantages.

By combining second fluid regulation with spill return pressure regulation, a lesser quantity of second fluid is required to achieve the same magnitude of Turndown Ratio referred above. In consequence, superior fluid atomization can be achieved, accompanied by economic savings because of reduction in the amount of second fluid used.

In the primary application using this arrangement, where the supply or spill return pressures are utilized to effect turndown, the second fluid pressure may be kept constant. This simplifies the control of such a device.

Referring now to the drawings, each of the fluid injectors depicted therein includes a multi-part barrel 1 supporting at its forward end a fluid atomizer assembly 2. The barrel would be suitably mounted in the wall of the boiler with its forward end inset from the boiler interior. The fluid atomizer assembly 2 shown in FIGS. 1 and 3, comprises an orifice plate 3 with a single discharge hole 13 and a swirl plate 4. Preferably, such assembly (modified as will appear) is as featured in the U.S. Pat. No. 3,692,245 to which reference is directed for a fuller disclosure thereof.

Figure 2:
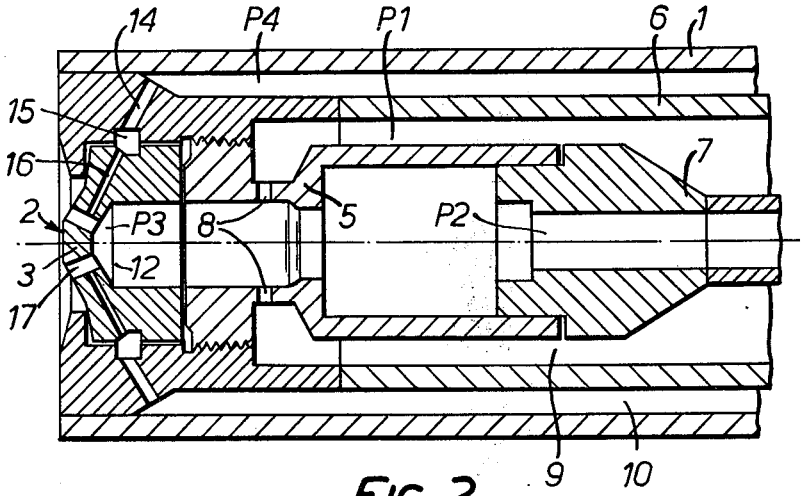
FIG. 2 is a sectional side elevation of a similar injector when operative to deliver fluids through a fluid atomizer having a plurality of discharge holes with provision to return fluid from the atomizer assembly.
Figure 4:
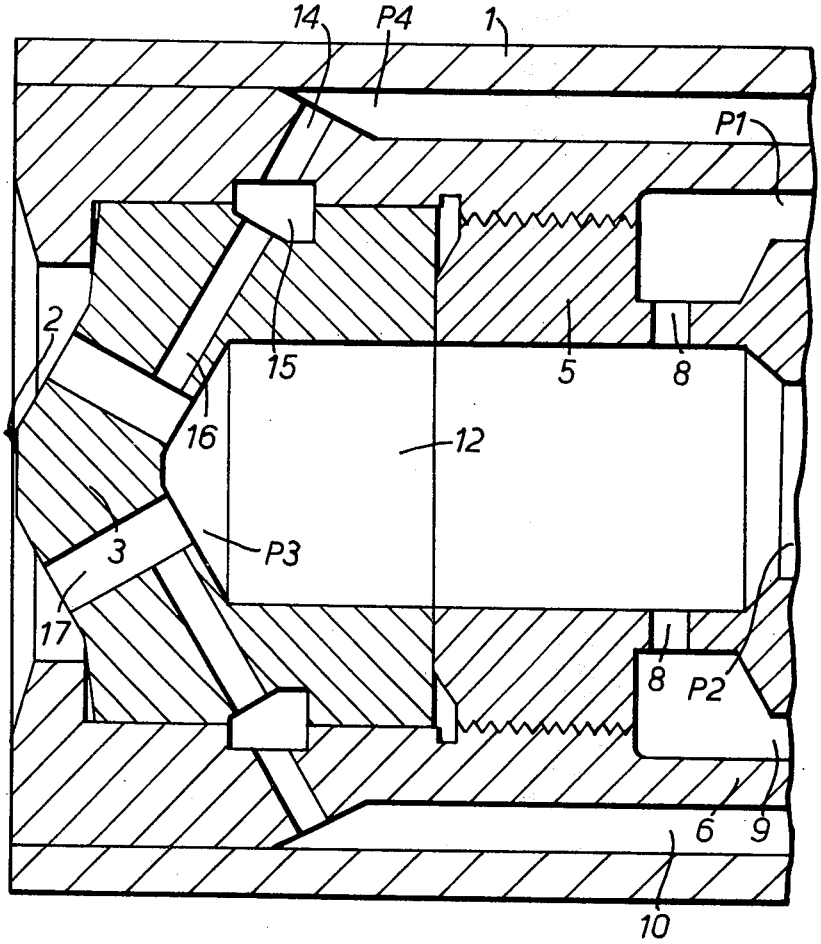
FIG. 4 is a detailed section to a larger scale showing details of FIG. 2.

In an alternative arrangement the fluid atomizer assembly 2 shown in FIGS. 2 and 4, comprises only an orifice plate 3.

In the embodiments shown in FIG. 1 and FIG. 2, the fluid atomizer assembly 2 abuts a cylindrical body 5 which is secured at its forward end to a multi-part division tube 6 so as to claim the atomizer assembly within the forward end of the division tube. At its rear end, the cylindrical body 5 is secured to a central tube 7.

The cylindrical body 5 contains holes 8 distributed around its circumference intended to achieve an equal distribution of fuel oil delivered to the fluid atomizer assembly 2.

An annular duct 9 formed between the division tube 6 and the interconnected central tube 7 and cylindrical body 5 would be coupled into a suitable oil fuel delivery circuit. The central tube 7 would be coupled into a suitable oil fuel return circuit. The details of the oil fuel delivery and return circuits may be conventional and form no part of this invention.

The multi-part division tube 6 with the atomizer assembly 2, cylindrical body 5 and central tube 7 are enclosed within the barrel 1. This arrangement forms an annular duct 10 between the division tube 6 and the barrel 1. The annular duct 10 would be coupled into a suitable steam or gas circuit, the details of which may be conventional and form no part of this invention.

Figure 3:
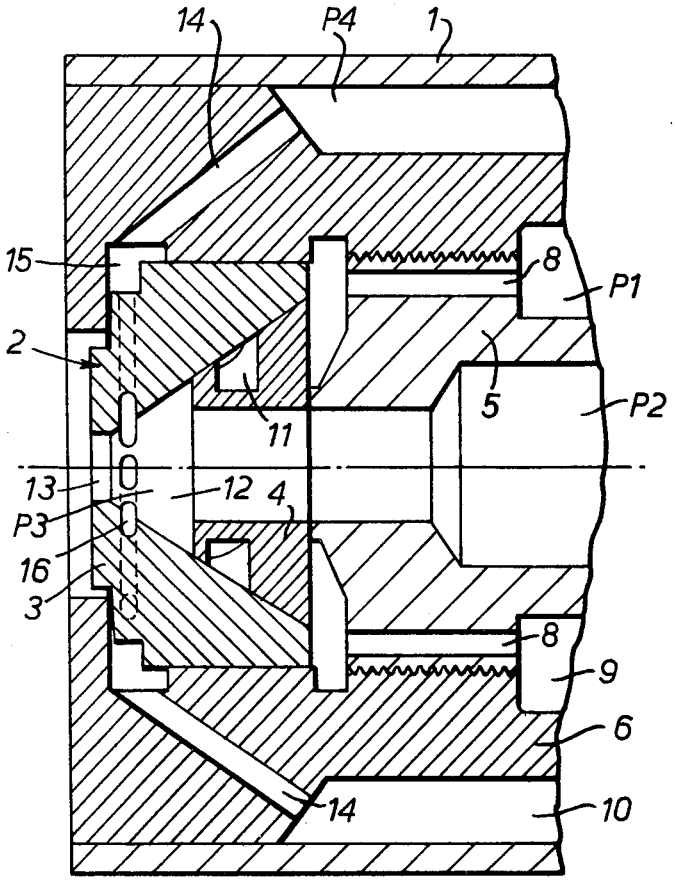
FIG. 3 is a detailed section to a larger scale showing details of FIG. 1.

With the embodiment shown in FIGS. 1 and 3, fuel oil is delivered through the annular duct 9 at a pressure P1 to pass around the cylindrical body 5 and discharge through the holes 8 to the fluid atomiser assembly 2.

In that embodiment, the swirl plate 4 is clamped into the orifice plate 3 by the cylindrical body 5 to form slots 11 between the swirl plate and the walls of the enclosing orifice plate, so that the fuel delivered to the fluid atomiser assembly 2 is constrained to pass through those slots to a chamber 12 formed within the orifice plate 3.

From the chamber 12, fuel discharges through the discharge hole 13 of the orifice plate 3 in a finely atomized spray, and some fuel may be returned through the swirl plate 4, the cylindrical body 5 and the central tube 7 to the return circuit.

Adjustment of the return pressure P2 in the central tube 7 determines that proportion of fuel delivered to the fluid atomiser assembly 2 which is returned to the return circuit, in so doing altering the quantity of fuel discharged through the discharge hole 13 for a given value of P1.

The process of fuel passing through the fluid atomizer assembly 2 causes a pressure gradient to exist in the chamber 12 so that a pressure P3 occurs adjacent to the discharge hole 13 which is related to but less than the pressure P2 in the central tube 7.

Steam or gas is made available in the annular duct 10 at a pressure P4. When pressures P1 and P2 in the fuel circuit are reduced so that the resultant pressure P3 in the chamber 12 is less than the pressure P4, then the steam or gas is able to, and will, flow from the annular duct 10 through a plurality of holes 14 into a chamber 15, wherefrom the steam or gas may pass through a plurality of holes 16 (constituting the aforesaid modification to the atomizer assembly), distributed around the circumference of the orifice plate 3 at a tangent to the circumference of the discharge hole 13, and into the chamber 12 therein to mix with the fuel oil to discharge through the discharge hole 13.

With the pressure P4 adjusted so that it is greater than the pressure P3 but less than the pressure P2, then, even though a proportion of the fuel delivered to the chamber 12 may be returned to the return circuit, steam or gas will not become entrained in the fuel oil so returned. In preference, the steam or gas will pass from the pressure region P4 to the pressure region P3 and thence discharge through the discharge hole 13 as being the path of least resistance. Adjusting the pressures P1 and P2 upward so that pressure P3 becomes greater than pressure P4, terminates the supply of steam or gas to the chamber 12.

A non-return valve which is conventional and that acts to permit a fluid flow in only one direction may be included in the steam or gas circuit at a point external to the fluid injector. The non-return valve would be arranged in the steam or gas circuit so that a fluid flow is permitted only in the direction from the steam or gas circuit into the fluid infector, as will occur when the pressure P4 is greater than the pressure P3 in the chamber 12. In operative circumstances when the pressure P3 becomes greater than the pressure P4 to terminate the supply of steam or gas to the fluid atomizer assembly, the non-return valve would be closed to prevent fuel oil from passing from the fluid injector into the steam or gas circuit.

In operation, the embodiment shown in FIGS. 2 and 4 is similar to that described above and illustrated in FIGS. 1 and 3, except that no swirl plate is included in the fluid atomiser assembly 2. Thus, fuel oil is delivered direct from the annular duct 9 through the holes 8 into the chamber 12, from where it may be discharged through a plurality of discharge holes 17.

In this embodiment, as described above when the pressure P3 is less than the pressure P4, steam or gas is caused to flow from the annular duct 10 through the plurality of holes 14 into the chamber 15 wherefrom the steam or gas may pass through the plurality of holes 16 distributed around the circumference of the orifice plate 3 into the discharge holes 17 therein to mix with the fuel oil discharged therethrough.

As described above, this embodiment includes the provision of the pressure gradient through the chamber 12 so that the pressure P3 is related to but less than the pressure P2 in the central tube 7. Thus, steam or gas will not become entrained in fuel oil returned through the central tube 7. Similarly, the provision of a non-return valve in the steam or gas circuit external to the fluid injector will present fuel oil passing back into the steam or gas circuit.

Figure 14:
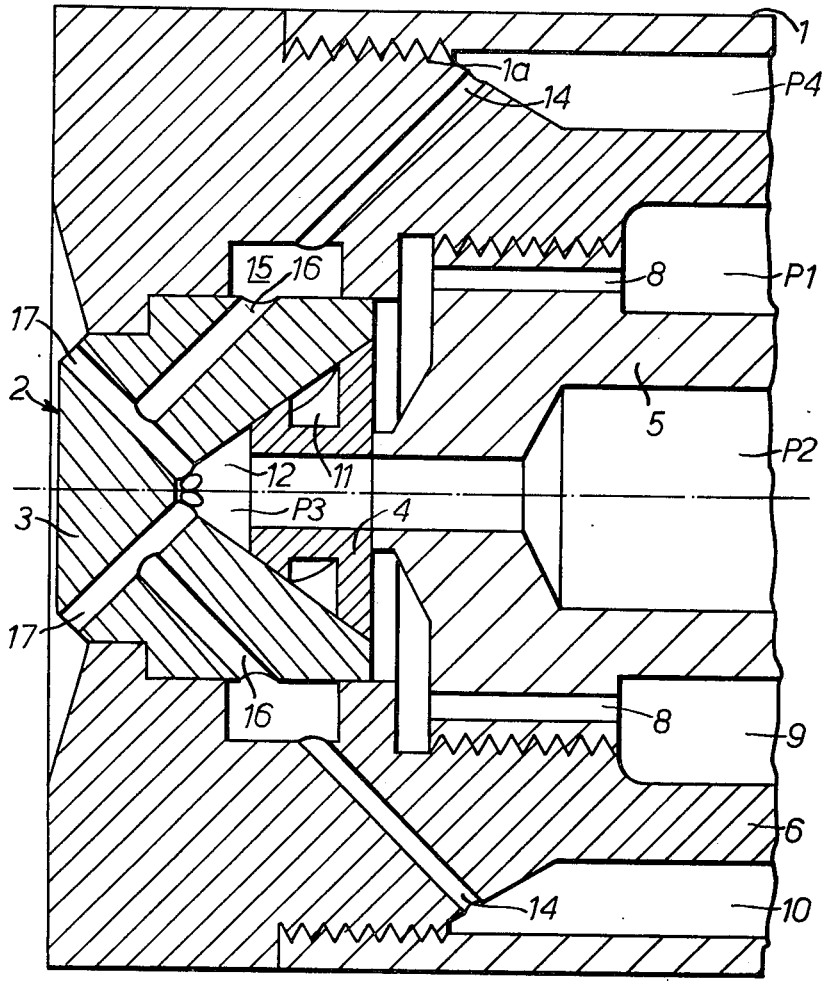
FIG. 14 is a detailed section showing an alternative, and preferred, front end of a fluid injector to those particularly depicted in FIGS. 3 and 4.

The front end of the fluid injector shown in FIG. 14 is a combination of elements taken from the injectors of FIGS. 3 and 4. Thus, the swirl plate 4, cylindrical body 5 and division tube 6 of FIG. 3 are used with the orifice plate 3 of FIG. 4. There is also a threaded connection 1*a* between the division tube 6 and the barrel 1. The arrangement appears to be superior in terms of its combustion performance.

Figure 5:
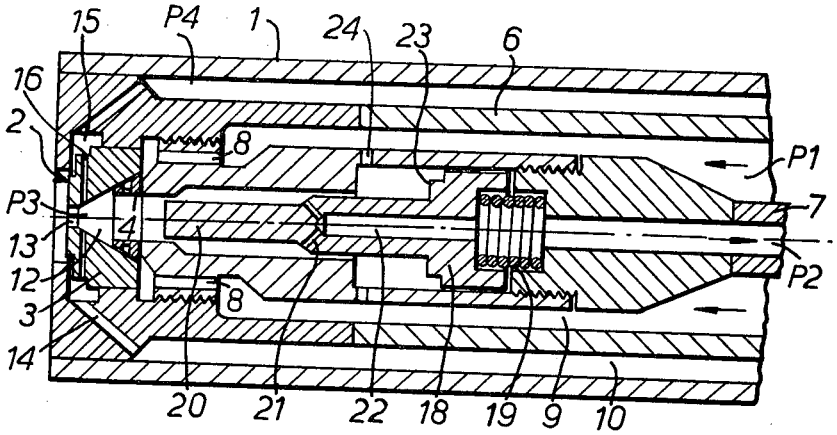
FIG. 5 is a sectional side elevation of a fluid injector when operative to deliver fluids through a fluid atomizer having a single discharge hole with provision to return fluid from the atomizer assembly, and the additional provision to terminate the supply of one fluid by the closure of hydraulically operated tip valve which seats in the fluid atomizer device.
Figure 6:
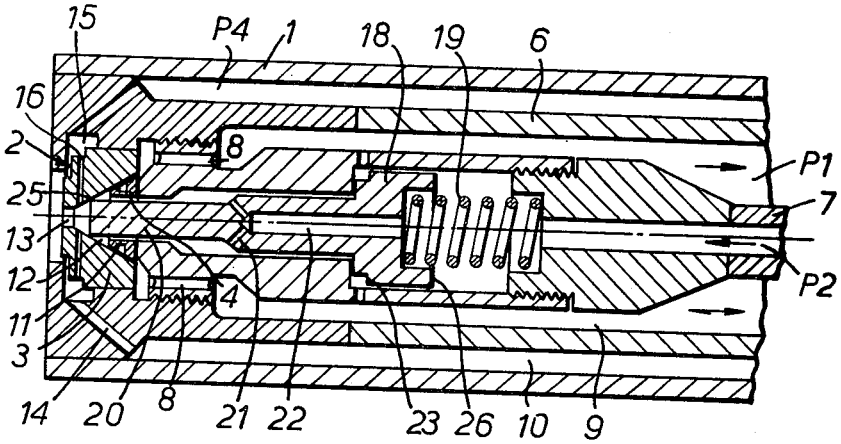
FIG. 6 is a similar view of the same injector as that shown in FIG. 5 when shut down.
Figure 7:
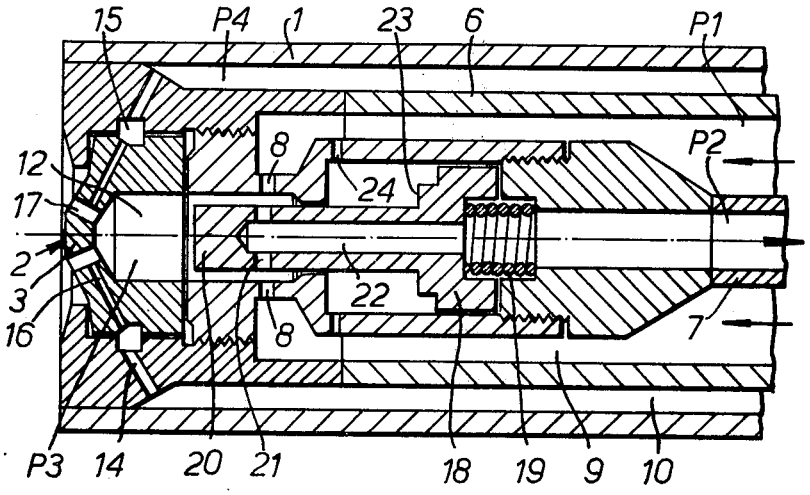
FIG. 7 is a sectional side elevation of a similar injector to that shown in FIG. 5 when operative to deliver fluids through a fluid atomizer having a plurality of discharge holes.
Figure 8:
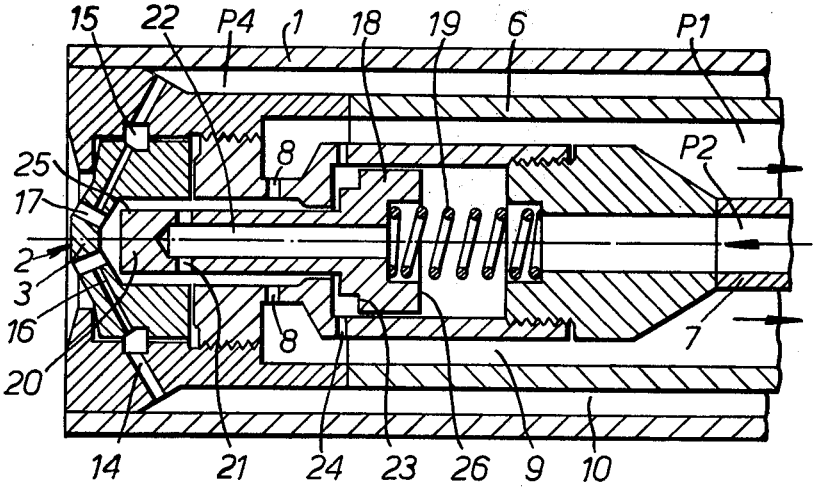
FIG. 8 is a sectional side elevation of the same injector as that shown in FIG. 7 when shut down.

In the two alternative embodiments shown in FIGS. 5 and 6, 7 and 8, the cylindrical body 6 contains a tip sealing valve 18 slidably mounted therein and biased forwardly by a spring 19. In all other respects the embodiment shown in FIGS. 5 and 6 is similar to that shown in FIGS. 1 and 3, and the embodiment shown in FIGS. 7 and 8 is similar to that shown in FIGS. 2 and 4. Both embodiments (modified to enable selective mixing of steam or gas with the fuel oil) are generally similar to the fluid injectors featured in U.S. Pat. No. 3,587,970 to which reference is directed. As another alternative, the fluid injector of U.S. Pat. No. 3,669,354 could (as will be appreciated by those skilled in the art reading the present disclosure in conjunction with that patent) be modified to permit such selective mixing. When there is no fluid supplied to the injector, the bias of the spring 19 is sufficient to urge the valve tip 20 into the orifice plate 3, so closing off the discharge holes 13 and 17 respectively.

Figure 15:
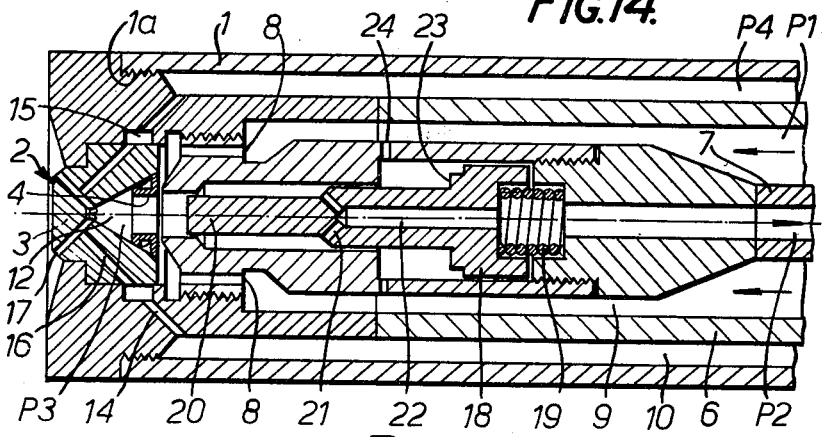
FIG. 15 is a sectional side elevation of a fluid injector in the open, operative condition annd constructed similarly to the injectors of FIGS. 6 to 8 but with a front end as illustrated in FIG. 14.

As yet a further alternative which is shown in FIG. 15, the front end of the injector as depicted in FIG. 14 is combined with the tip sealing valve construction of either of the FIGS. 5 and 6 and FIGS. 7 and 8 embodiments.

Normally, that is in either mode of operation with the tip sealing valve 18 open to discharge fuel oil or closed to circulate fuel oil through the fluid injector, fluid is continuously supplied to the injector. The position of the tip sealing valve 18 is controlled by the differential as occurs between the pressure P1 and pressure P2.

The mode of operation of the tip sealing valve 18 is determined by the direction of fuel flow as distributed between the annular duct 9 and the central tube 7.

In FIGS. 5, 7 and 15 the tip sealing valve 18 is shown open to discharge fuel oil through the discharge holes 13 and 17 respectively. In this mode of operation, fuel oil is delivered along the annular duct 9 via the holes 8 into the chamber 12 and may be returned from the chamber 12 through the swirl plate 4 shown in FIGS. 5 and 15 or direct, as shown in FIG. 7, via holes 21 into a hole 22 in the central tube 7. The direction of fuel flow is thus as indicated by the arrows on FIGS. 5, 7 and 15.

The tip sealing valve 18 is held in the open position because the fuel oil at pressure P1 passes to a face 23 of the tip sealing valve via a plurality of holes 24 passing through the cylindrical body 7. The pressure P1 is sufficiently greater than the pressure P2 so that a differential pressure acts across the tip sealing valve 18 to hold it against the bias of the spring 19 in the open position.

In FIGS. 6 and 8, the tip sealing valve 18 is shown closed to terminate the supply of fuel oil from the chamber 12 to the discharge holes 13 and 17 respectively. In this mode of operation, fuel oil is delivered along the central tube 7 via the hole 22 in the tip sealing valve 18 and through holes 21 therein to discharge into the chamber 12 on the closed side of the tip valve seat 25. As shown in FIG. 6, fuel oil passes from the chamber 12 via the slots 11 in the swirl plate 4 through the holes 8 into the annular duct 9, or as shown in FIG. 8 direct from the chamber 12 through the holes 8 into the annular duct 9, wherefrom it is returned to the return fuel circuit. The direction of fuel flow is thus as indicated by the arrows on FIGS. 6 and 8.

In this mode of operation, the pressure P2 acting upon the face 26 is sufficiently greater than the pressure P1 acting upon the face 23, and the differential pressure then acts augmented by the bias of the spring 19 to maintain the tip sealing valve 18 in the closed mode of operation.

In FIGS. 9 to 12, a change-over valve 114 the construction of which is as disclosed in U.S. Pat. Nos.

3,587,970 and 3,669,354 to which attention has been directed is shown in different operating conditions. By connecting the central tube 7 and division tube 6 with the change-over valve 114, the change-over valve can be selectively axially moved with the central tube and a control sleeve 136 to reverse the direction of flow as between the annular duct 9 and the central tube 7. The change-over valve connects to fixed fuel supply and return terminals 112 and 113 respectively, which in turn connect to the fuel supply and return circuits external to the fluid injection system, the details of which may be conventional and form no part of the present invention.

Figure 9:
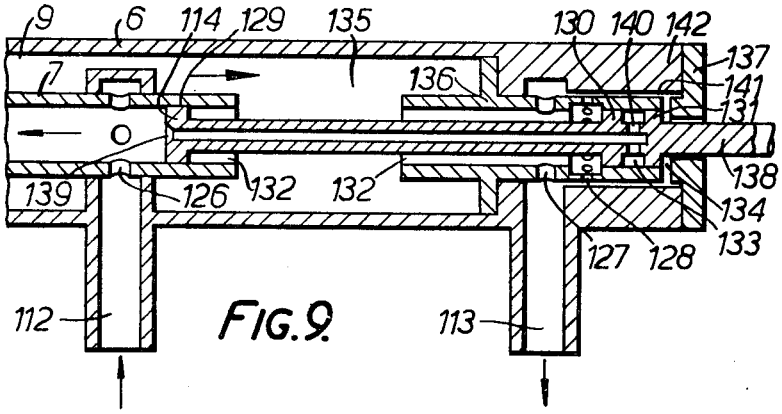
FIG. 9 is a sectional side elevation of a change-over valve, given as an example, to operate the tip valve shown in FIGS. 5, 6, 7, 8 and 15, and depicted in the shut-down condition of the fluid injector.

In the position of the valve 114 shown in FIG. 9, the oil is supplied through the central tube 7, and passes via the atomizer assembly 2 to return through the annular duct 9. Such oil flow, as aforesaid, effects a differential pressure operating to close the valve tip 20 against the orifice plate 37. Thus, no oil will be discharged from the injector. Even so, during that time there is a continuous circulation of oil within the injector. The quantity of fluid which circulates within the injector can be regulated, as will be described.

Figure 11:
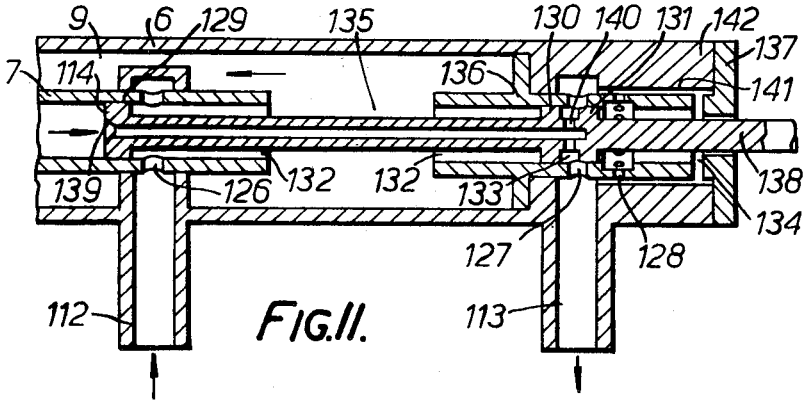
FIG. 11 is a similar view of the same injector when operative to discharge fluid.

In the position of the valve 114 shown in FIG 11, the reverse oil flow occurs through the injector. In this case, as aforesaid, the differential pressure acting on the tip sealing valve 18 retracts the tip 20 thereof, against the bias of the spring 19, to open the discharge hole or holes; oil will, accordingly, be discharged therethrough. A proportion of the oil supplied to the injector will not be discharged but will return through the central tube 7. That proportion, and hence the quantity of oil which is discharged, can be regulated, as will be described.

The position of that valve 114 in relation to ports 127, 128, also controls the relative proportions of fluid discharge through the discharge hole or holes, and fluid spill return flow through the central tube 7 when the tip valve 18 is open, and of fluid continuously circulated within the injector when the tipvalve is closed.

The valve 114 comprises a spool having a land 129 in sliding engagement with the central tube 7, and lands 130, 131 in sliding engagement with the central sleeve 136. The lands 129, 130, 131, define therebetween chambers 132, 133. The chamber 132, is maintained in communication with the duct 9, by an aperture 135 provided between the control sleeve 136 and the central tube 7. Another chamber 134 is defined between the land 131 and a closure member 137 serving to close the rear end of the injector and make a liquid seal with a plunger 138 of the valve 114. That plunger would be operative manually or be connected to any suitable power means such as an electrical solenoid or air cylinder so as to be reciprocally movable under selective control. The ports 127, 128 are provided in the wall of the control sleeve 136, and ports 126 are provided in the wall of the central tube 7.

When the change-over valve 114 is in the position shown in FIG. 9, the land 129 is positioned behind the ports 126 having direct communication with the fluid supply terminal 112 so that fluid will flow from that terminal via the ports 126 and into the central tube 7 to pass therealong towards the atomizer assembly 2. A return path from the duct 9 to the return terminal 113 is provided by way of the aperture 135 and the ports 127, such that the fluid will return from the duct 9 via the aperture 135 into the chamber 132 and pass therefrom via the ports 127 into the return terminal 113.

Figure 10:
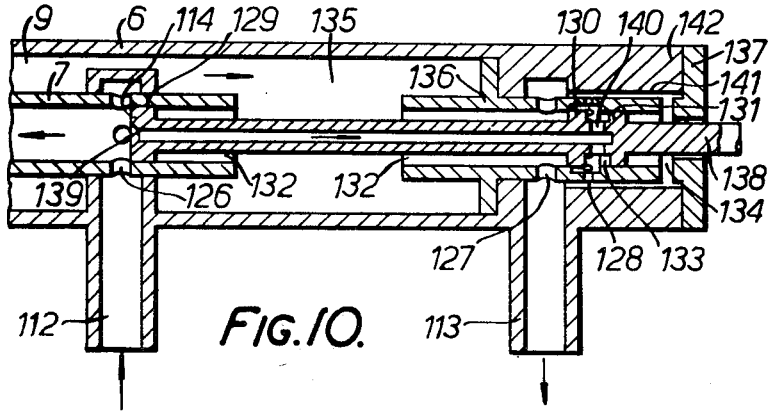
FIG. 10 is a similar view of the injector of FIG. 9 when shut-down, which shows the introduction of additional fluid circulating within the injector.

With the injector maintained in the shut off condition as shown in FIG. 10, additional circulating flow may be introduced by connecting a central passage 139 in the valve 114 via the chamber 133 to the ports 128 so that the fluid will pass therefrom into the return terminal 113. Care must be taken to ensure that the fluid flow returning from the duct 9 into the return terminal 113 is not reduced, when the valve 114 is moved inwardly to introduce additional circulation within the injector.

To effect a discharge condition, the change-over valve 114 is moved inwardly to the position shown in FIG. 11 in which the land 129 lies forwardly of the supply terminal 112 and ports 126 to interrupt communication between those ports 126 and the forward region of the central tube 7. Instead, the ports 126 communicate with the chamber 132 with the result that flow will occur into that chamber 132 and exit therefrom via the aperture 135 into the duct 9. Return from the atomizer assembly 2 takes place via the central tube 7 to the land 129, and then through the central passage 139 in the valve 114 and ports 140 therefrom into the chamber 133, to exit via the ports 127 into the return terminal 113.

With the injector in the discharge condition, the fluid spill return flow into the return terminal 113 can be regulated to obtain a corresponding variation in the discharge flow. A lesser fluid spill return flow and hence a greater discharge flow is obtained by moving the change-over valve 114 inwardly, so that the land 131 is caused to interfere with the fluid spill return flow from the chamber 133 via the port 127 into the return terminal 133. This fluid spill return flow can be shut off entirely by continuing to move the change-over valve 114 inwardly until it is in the position shown in FIG. 12. At this position the discharge flow will be a maximum for a particular size of discharge hole 11, and a particular supply pressure.

Care must be taken to ensure that the tip sealing valve 8 can move to the discharge position before the fluid spill return flow is shut off entirely. Otherwise a hydraulic lock will be caused in the central tube 7, which will render the tip sealing valve inoperative.

There is an annular gap 141 between the rear end of the control sleeve 136 and the associated end 142 of the tube 6. In the absence of that gap, there would tend to be a hydraulic lock when the change-over valve is retracted caused by fluid being trapped in the chamber 134. With the annular gap, such fluid will be displaced from the chamber and into the return terminal 113.

An external adjustment mechanism can be in rigid connection with the change-over valve at 127 to adjust the distribution of fluid flow through the change-over valve. The mechanism can be set so that the total of fuel oil delivered to the fluid injector is equal in either mode of operation with the tip sealing valve, open to discharge fuel oil or closed to circulate fuel oil through the fluid injector. For example the immediately aforesaid patents disclose a suitable mechanism which is shown herein by FIG. 13.

Figure 13:
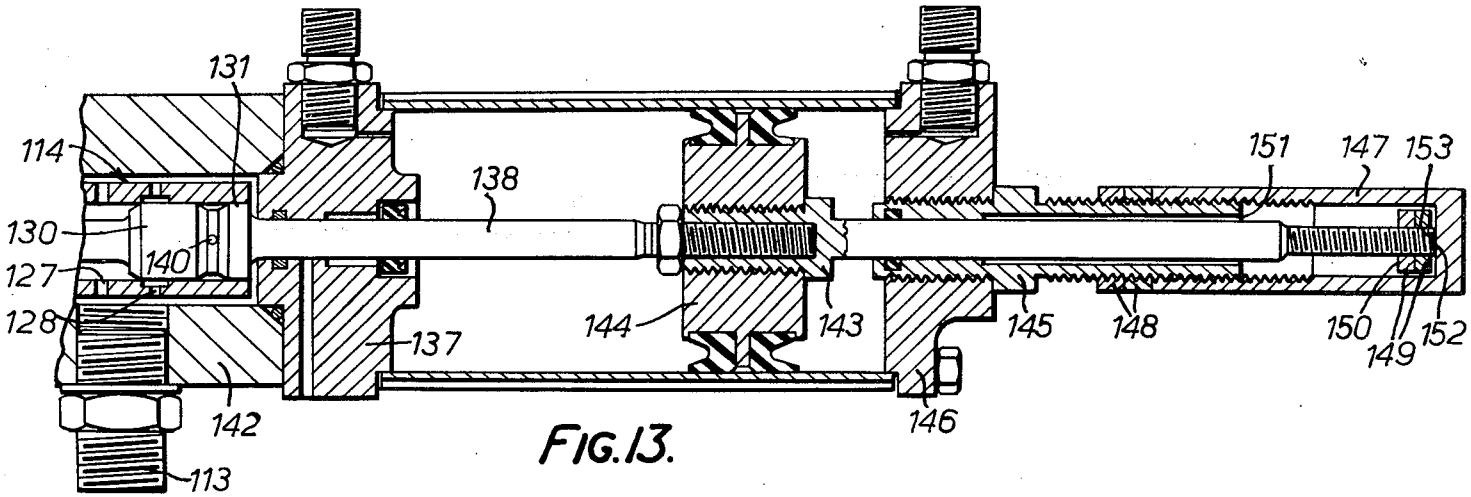
FIG. 13 is a sectional side elevation of an adjustment device, given as an example, for use in connection with the change-over valve of FIGS. 9 to 12.

From FIG. 13 it can be seen that an adjustment spindle 143 is in rigid connection with the plunger 138 of the change-over valve 114 at a power operative drive sleeve 144. The spindle 143 slides in an adjustment sleeve 145 which is part of a power operator support frame 146. The spindle 143 is enclosed by a barrel 147 which is screwed in engagement with the sleeve 145. The barrel 147 abuts adjustment nuts 148 which are also in screwed engagement with the sleeve 145. Adjustment nuts 149 are in screwed engagement with the spindle 143 and form a land 150 which abuts a land 151 formed on the end of the sleeve 145. A land 152 is formed on the end of the spindle 143, and a land 153 is formed inside the barrel 147.

To adjust the circulating fluid within the fluid injector, as in FIG. 10, the nuts 148 are screwed inwardly so that the barrel 147 which abuts them can be moved in. Thus, the travel of the spindle 143 is restricted because the land 152 abuts the land 153, causing the valve 114 to move inwardly.

Figure 12:
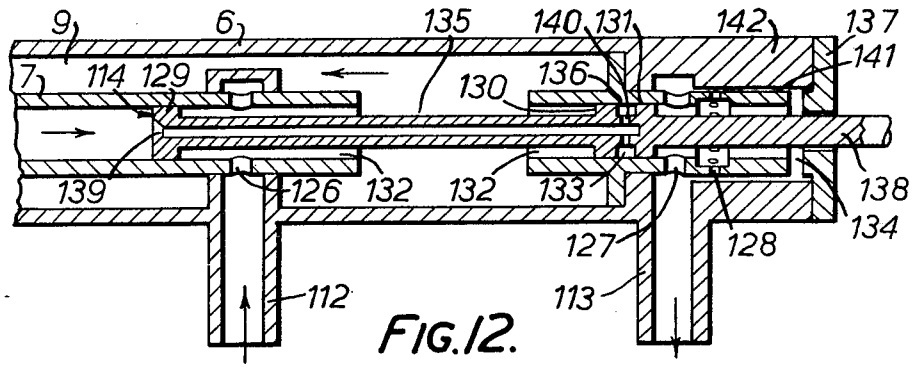
FIG. 12 is a similar view showing the injector in the discharge condition, but with the change-over valve thereof in a different position, so as to regulate the quantity of discharged fluid.

The fluid spill return flow is regulated, as shown in FIGS. 11 and 12, by the nuts 149 which abut the land 151, and they can be unscrewed allowing the spindle 143 a controlled inward movement.

With the tip sealing valve 18 incorporated into the fluid injector, the pressure distributions as between fuel oil in the duct 9, the central tube 7, and the chamber 12, and the steam or gas in the duct 10, as previously described, are so arranged that the adjustment of pressures to discharge or terminate steam or gas in no way interferes with the operation of the tip sealing valve when selected for the open or closed modes of operation.

As has been explained, the introduction or termination of steam or gas is governed by the direction of differential pressure acting between the pressure P3 and the pressure P4, whereas the operating mode of the tip sealing valve 18 is determined by the direction of the differential pressure acting between pressure P1 and pressure P2.

With the tip sealing valve in the open mode of operation, the pressure P1 acts upon the face 23 to hold the tip sealing valve in the open position. The fuel passing through the fluid atomizer assembly 2 creates the pressure gradient in the chamber 12 as previously described, so that the pressure P3 is related to but less than the pressure P2 in the central tube. Due to the velocity head losses which occur through the holes 8 and the holes 21, the pressure P2 in turn is less than the pressure P1. Thus, when the pressure P1 and P2 are reduced so that the resultant pressure P3 in the chamber 12 is less than the pressure P4, and steam or gas is caused to flow, the differential pressure which acts between the pressure P1 and the pressure P2 continues to maintain the tip sealing valve in the open position, because the pressure P3 has also reduced as previously explained in relation to but less than the pressure P2.

With the tip sealing valve selected to the closed mode of operation, then the steam or gas circuit is isolated from the fuel oil delivery and return circuits. In this instance, the direction of flow is reversed so that the pressure P2 becomes greater than the pressure P1, and the differential pressure acts to hold the tip sealing valve in the closed position.

In these embodiments with the tip sealing valve in the open mode of operation, because the pressure gradient exists in the chamber 12 and distribution of pressures P3 and P2 is similar to that for the embodiments previously described, then steam or gas will not become entrained in fuel oil returned through the central tube. Similarly, the provision of a non-return valve in the steam or gas circuit external to the fluid injector, will prevent fuel oil passing back into the steam or gas circuit.

The embodiments of the fluid injector which includes the tip sealing valve is advantageous in that during shut off, fluid is continuously circulated through the injector to cool it and obviate the need for the injector to be retracted away from the interior of the boiler. Again, because of that continuous circulation, fuel cracking and blockage in the injector are obviated and there is no necessity for cleaning between discharge operations. The tip sealing and change-over valves are self-contained units, which permits their easy removal for service or replacing; the ingress of dust into the valve system is prevented because the change-over valve is enclosed in the central tube as an integral part of the injector. The fuel flow for a particular pressure can be maintained at constant volume when the injector is operated by presetting the circulating flow when the injector is in the shut-off condition, and permits taking-off and putting-on burners without disturbing the total fuel flow. The components of the injector are so sized that the injector may be housed in standard carrier tubes.

The multi-fluid injector is advantageous in all its embodiments described above. In its primary application, the injector combines the use of steam or gas with a mechanically atomized fluid injection system, having the means to spill return fluid during discharge, to obtain a wider range of discharges without impairing the quality of fluid atomization. In all the embodiments, the steam or gas circuits are separated from the fuel supply and return circuits in such a way that the steam or gas cannot become entrained in the fuel circuits, and conversely, the fuel cannot become entrained in the steam or gas circuit.

As previously discussed the process of altering the fluid discharge through the range of discharges is commonly terms 'turn-down'.

With the injector in an operative condition such that the pressure P3 is greater than the pressure P4, the discharge of fluid is regulated to obtain turn-down by altering either or both the pressures P1 and P2. The alteration of the pressures P1 and P2 regulates the quantity of fluid returned through the central tube thus regulating the quantity of fluid which is discharged through the discharge holes.

As was described above, with the injector operative to discharge fluid, then when the pressure P3 is reduced so that it is less than the pressure P4, a second fluid, steam or gas, may be discharged through the discharge holes at the instant of discharging fuel oil. Because the steam or gas then passes through the discharge holes as well as fuel oil, the quantity of fuel oil passing through the discharge holes is reduced. The quantity of steam or gas which can thus be discharged is varied by regulating the differential pressure as between the pressures P3 and P4, and accordingly regulates the quantity of fuel oil discharged.

By combining the use of regulated oil spill return with the embodiment of regulated steam or gas discharge, a wider range of fuel oil discharges may be obtained for a given size of multi-fluid injector. The scale and range of discharges in addition to being regulated by the pressure differentials referred above, are characterized by the number and size of holes 16, discharge holes 13 and 17, slots 11, and where a tip sealing valve is incorporated, holes 21.

With these embodiments to regulate fuel oil discharges by the use of steam or gas and fuel spill return, in the primary application regulation of the fuel discharges may be achieved initially using only the spill return or fluid, with the introduction of steam or gas at a lower point to consequently widen the range through which the fuel discharges can be turned down. By this means the steam or gas consumption for a given scale of discharges expressed as a proportion of total energy available, is reduced.

The capability to introduce steam or gas has the further advantage that when the fluid injector is operated so as not to discharge fuel oil, the steam or gas can be selected to purge the discharge holes incorporated in the atomizer assembly, thus clearing any fuel oil deposits which may persist to prevent blockage of the discharge holes. In its primary application the steam or gas will also provide adequate cooling of these parts to prevent their softening in use.

When the fluid injector is employed for the discharge of heavy fuel oils which require heating in order to exist in a liquid state, then failure of the heating or pump plant can cause such fuel oil to coagulate and solidify in the fluid injector. In this circumstance, it is of particular value that in the embodiments described above, steam may be selected to pass through the outer duct to discharge through the atomiser assembly, and in so doing the steam may be employed to heat the fluid injector and restore the heavy fuel oil to a liquid state.

What we claim is:

1. Fluid injector apparatus, comprising a. a hollow injector body (1) containing at one end a discharge chamber (12) and including at least one discharge orifice (13; 17) for discharging fluid from said discharge chamber;

b. liquid supply passage means (9, 8) contained in said injector body for supplying liquid to said discharge chamber;

c. liquid return passage means (7) contained in said injector body for returning liquid from said discharge chamber;

d. gas supply passage means (10, 14) contained in said injector body for supplying a gaseous fluid adjacent said discharge orifice;

e. means causing the pressure (P3) of the fluid in said discharge chamber to be less than the pressure (P2) in said return passage means, whereby a portion of the liquid in said discharge chamber is discharged via said discharge orifice; and f. means causing the pressure (P4) of the fluid in said gas supply passage means to be greater than the pressure (P3) of the fluid in said discharge chamber, whereby the gaseous fluid is discharged via said discharge orifice in mixed relation with the discharged liquid portion.

2. Apparatus as defined in claim 1, and further including means for varying the pressure (P3) of fluid in said discharge chamber relative to the pressure (P4) of the gaseous fluid in said gas supply passage means, thereby to vary the amount of liquid discharged from said discharge chamber via said discharge orifice.

3. Apparatus as defined in claim 2, wherein said means for varying the fluid pressure of said discharge chamber includes means (100, 8) for effecting a variation in the supply liquid pressure.

4. Apparatus as defined in claim 2, wherein said means for varying the pressure of fluid in said discharge chamber includes means (101, 7) for varying the return liquid pressure.

5. Apparatus as defined in claim 2, wherein said means for varying the pressure of fluid in said discharge chamber includes means (100, 8; 101, 7) for varying both the supply liquid pressure and the return liquid pressure.

6. Apparatus as defined in claim 1, and further including means for causing the pressure (P4) of the fluid in said gas supply passage means to be greater than the pressure (P3) of fluid in said discharge chamber, whereby the discharge of the gaseous fluid from said discharge orifice is terminated.

7. Apparatus as defined in claim 1, and further including means for varying the return liquid pressure (P2) relative to the liquid supply pressure (P1), thereby to vary the amount of the liquid portion that is discharged from said discharge chamber via said discharge orifice.

8. Apparatus as defined in claim 1, and further including means for varying the pressure (P4) of the gaseous fluid in said gas supply passage means relative to the pressure (P3) of fluid in said discharge chamber, thereby to vary the amount of the liquid portion that is discharged from said discharge chamber via said discharge orifice.

9. Apparatus as defined in claim 1, and further including tip sealing valve means (18) mounted in said injector body for controlling the discharge of fluid from said discharge chamber via said discharge orifice, said top sealing valve means being operable between open and closed positions relative to said discharge orifice when the liquid supply and return pressures have first and second pressure differential values, respectively.

10. Apparatus as defined in claim 9, wherein said tip sealing valve means is so arranged relative to said discharge orifice and said gas supply passage means that said gas supply passage means is isolated from the liquid supply and return passage means when the tip sealing valve means is in the closed condition.

11. Apparatus as defined in claim 1, and further including change-over valve means operable between a first condition in which a portion of the liquid in the discharge chamber is discharged via said discharge orifice and the remaining fluid is returned via said liquid return passage means, and a second condition in which no liquid is discharged via said discharge orifice, all the liquid being continuously returned for recirculation via said liquid return passage means.

12. Apparatus as defined in claim 1, wherein said housing further includes inlet (112) and outlet ports (113) for connection with a fluid source and with sump, respectively, said discharge orifice being of the atomizer type (2); and further including g. tip sealing valve means (18) arranged in said housing and pressure-differentially operable between open and closed positions in which the discharge chamber is in communication with, and is isolated from, said discharge orifice, respectively, said liquid supply and return passage means being in continuous communication when said tip sealing valve means is in the open and closed conditions, respectively; and h. change-over valve means (114) arranged in said housing and linearly operable between first and second positions relative to said inlet and outlet ports to establish pressure differentials causing said tip sealing valve means to be closed and open, respectively.

13. Apparatus as defined in claim 12, wherein said change-over valve means is also linearly operable between a plurality of liquid discharge positions for varying the pressure of said discharge chamber relative to that of the fluid in the liquid return chamber for a given liquid supply pressure, thereby to vary the amount of the liquid portion that is discharged from the discharge chamber via said discharge orifice.

14. Apparatus as defined in claim 13, wherein said change-over valve means is operable to reverse the direction of liquid flow in both the liquid supply passage means and in the liquid return passage means.

15. Apparatus as defined in claim 13, wherein said change-over valve means is operable to a position effecting opening of the top sealing valve means and closing of the liquid return passage means, thereby to effect maximum discharge of the liquid from said discharge chamber via said discharge orifice.

16. Apparatus as defined in claim 12 wherein said change-over valve means is operable to a position effecting opening of the tip sealing valve means and providing communication between said inlet and return ports both in a first path including said liquid supply passage means, said discharge chamber, and said liquid return passage means, and in a second path directly from said liquid inlet port to said liquid return port.

17. Apparatus as defined in claim 9, and further including change-over valve means 114 for reversing the direction of liquid flow in said liquid supply and return passage means, respectively.

18. Apparatus as defined in claim 1, wherein said injection body includes an orifice plate containing a plurality of discharge orifices (17).

19. Apparatus as defined in claim 18, wherein said discharge chamber converges axially in the direction of the discharge orifices, and further including swirl plate means (4) arranged in the converging portion of said discharge chamber.

20. Apparatus as defined in claim 1, wherein said injector body includes an orifice plate containing a single centrallyarranged discharge orifice, said discharge chamber converging axially in the direction of said discharge orifice, and further including swirl plate means (4) arranged in the converging portion of said discharge chamber.

21. Apparatus as defined in claim 1, wherein said liquid return passage means comprises a first tubular member (7) containing the liquid return passage; wherein said liquid supply passage means includes a second tubular member (6) arranged in concentrically spaced relation about said first tubular member, the annular space between said first and second members constituting said liquid supply passage; and further wherein said gas supply passage means includes a third tubular member (1) arranged in concentrically spaced relation about said second tubular member, the annular space between said second and third tubular members constituting said gas supply passage.

* * * * *